United States Patent [19]

Poling

[11] Patent Number: 4,691,618

[45] Date of Patent: Sep. 8, 1987

[54] HYDRAULIC CONTROL VALVE

[76] Inventor: Denzil C. Poling, Rte. 6, Box 80, Hagerstown, Md. 21740

[21] Appl. No.: 859,992

[22] Filed: May 5, 1986

[51] Int. Cl.[4] ..... F15B 13/04

[52] U.S. Cl. ..... 91/326; 91/330; 91/466; 137/596.12; 137/625.17; 137/625.69

[58] Field of Search ..... 91/218, 326, 330, 466; 137/596.12, 625.17, 625.69, 625.43

[56] References Cited

U.S. PATENT DOCUMENTS

| | | | |
|---|---|---|---|
| 94,097 | 8/1869 | Frizell | 91/218 X |
| 1,123,273 | 1/1915 | Gregersen | 137/625.69 |
| 1,747,899 | 2/1930 | Hogg . | |
| 2,051,137 | 8/1936 | Galleher | 137/596.12 |
| 2,312,432 | 3/1943 | Mercier | 137/625.69 X |
| 2,496,036 | 1/1950 | Christensen | 251/76 |
| 2,906,492 | 9/1959 | Conrad | 251/325 |
| 3,472,281 | 10/1969 | Chiba et al. | 137/625.69 |
| 3,773,083 | 11/1973 | Hague et al. | 137/625.69 |
| 4,022,425 | 5/1977 | Govzman et al. | 251/324 |
| 4,367,763 | 1/1983 | Brand | 137/106 |

OTHER PUBLICATIONS

*Energy Hydraulics* advertisement (undated).

*Primary Examiner*—Gerald A. Michalsky
*Attorney, Agent, or Firm*—Bernard, Rothwell & Brown

[57] ABSTRACT

A hydraulic control valve having a valve housing including a cylindrical valve bore, the valve bore being in communication with a supply port, a discharge port and first and second delivery ports each with first and second openings to the valve bore. A valve pin is slidable within the valve bore, the valve pin including first and second pin grooves operable to establish communication between the supply port and either of the delivery ports to the exclusion of the other delivery port, the supply port and discharge port communication being establishable through corresponding valve bore openings of respective delivery ports. Supply port communication with one of the delivery ports is establishable simultaneously with discharge port communication with the other delivery port.

26 Claims, 14 Drawing Figures

HYDRAULIC CONTROL VALVE

BACKGROUND OF THE INVENTION

1. Field of the Invention

The present invention relates to a hydraulic control valve.

2. Description of the Background Art

A variety of hydraulic control valves are known in the prior art, examples of which are shown in U.S. Pat. Nos. 2,496,036; 3,472,281; 4,022,425 and 4,367,763. Hydraulic control valves have many uses, such as, for example, for controlling extension and retraction of cylinder rods in hydraulic log splitters.

Typically, control valves for hydraulic log splitters are manually controllable to apply hydraulic pressure to a cylinder for extension of the rod and splitting of the log. Where it has been desirable to provide for automatic retraction of the cylinder rod after a log has been split, prior art devices generally utilize electrical means such as solenoid switches to control the hydraulic valve and reverse the direction of the cylinder rod. However, the use of electrical parts in high moisture areas can prove problematic, and obviously a source of electricity must be available to operate such electrical devices.

There remains a need in the art for reliable and relatively inexpensive hydraulic control valves which are suitable for use with log splitters and capable of providing such splitters with automatic cylinder rod retraction capabilities without using electrical parts.

SUMMARY OF THE INVENTION

In accordance with the present invention, a hydraulic control valve includes a valve housing having a cylindrical valve bore, the valve housing further including a supply port in communication with the valve bore. Also in communication with the valve bore are a discharge port and first and second delivery ports, each delivery port having first and second openings into the valve bore. The hydraulic valve further includes a valve pin slidable within the valve bore, the valve pin including a first pin groove operable to establish communication between the supply port and either of the delivery ports to the exclusion of the other delivery port. Supply port communication with either of the delivery ports is established through corresponding first valve bore openings of the respective delivery ports. The valve pin further includes a second pin groove operable to establish communication between the discharge port and either of the delivery ports to the exclusion of the other delivery port. Discharge port communication with either of the delivery ports is establishable through corresponding second valve bore openings of the respective delivery ports. Supply port communication with one of the delivery ports is establishable simultaneously with discharge port communication with the other delivery port.

DESCRIPTION OF THE PREFERRED EMBODIMENTS

Figure 1:
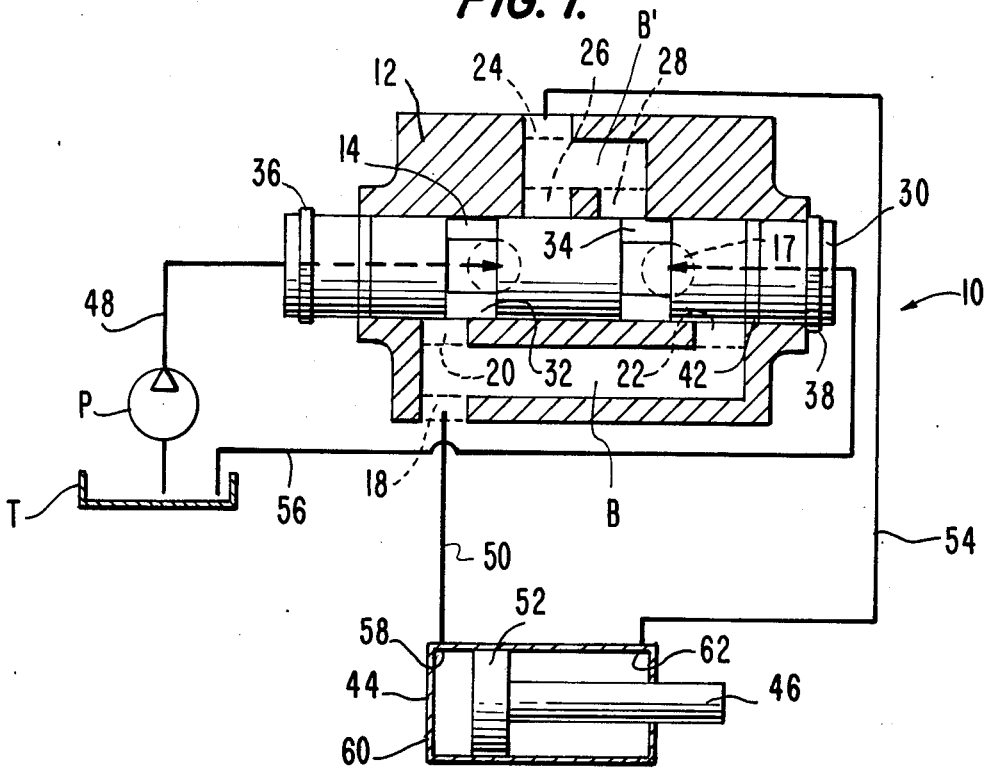
FIG. 1 is a sectional view, partly schematic, of a hydraulic control valve according to the invention connected to hydraulic pump and sump means as well as a hydraulic cylinder, the valve being in position for extension of the hydraulic cylinder rod.

With reference to FIGS. 1–8, a hydraulic control valve 10 includes a valve housing 12 having a cylindrical valve bore 14. In communication with valve bore 14 are a supply port 16 in the valve housing and a discharge port 17 in the valve housing, which, in the embodiment shown, are on one side of the valve housing with respect to the bore axis. Also in communication with valve bore 14 are first delivery port 18 in the valve housing in communication with a first blind bore B, the first blind bore B having first and second openings 20 and 22 respectively into the valve bore 14, and second delivery port 24 in the valve housing in communication with a second blind bore B′, the second blind bore B′ having first and second openings 26 and 28 respectively into the valve bore 14. In the embodiment shown, first and second delivery ports 18 and 24, and their respective blind bores B and B′, are on opposite sides of the valve housing with respect to the valve bore axis, and on different sides of the valve housing than supply port 16 and discharge port 17.

A valve pin 30 is slidable within valve bore 14. Valve pin 30 includes a first pin groove 32 operable to establish communication between supply port 16 and either of the delivery ports 18 or 24 to the exclusion of the other delivery port. Communication of supply port 16 is alternately establishable with delivery ports 18 or 24 through corresponding first valve bore openings 20 or 26 respectively of delivery ports 18 or 24. Slidable valve pin 30 further includes a second pin groove 34 operable to establish communication between discharge port 17 and either of the delivery ports 24 or 18 to the exclusion of the other delivery port. Communication of discharge port 17 with either of the delivery ports 24 or 18 is establishable through corresponding second valve bore openings 28 or 22 respectively of respective delivery ports 24 or 22. Compare FIGS. 1 and 2.

Figure 3:
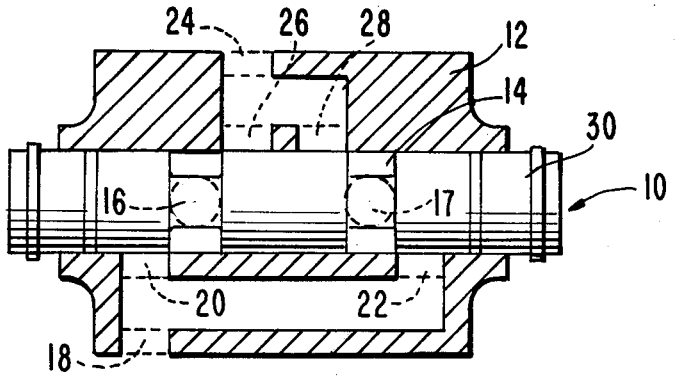
FIG. 3 is a sectional view of the valve of this invention with a valve pin centrally located in the valve housing.
Figure 4:
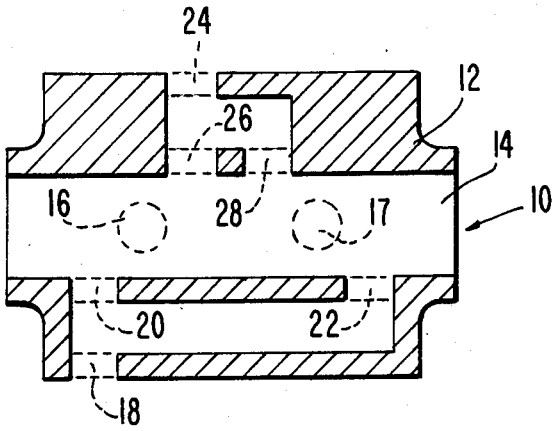
FIG. 4 is a sectional view of the valve housing of a valve according to the present invention with the valve pin removed.
Figure 5:
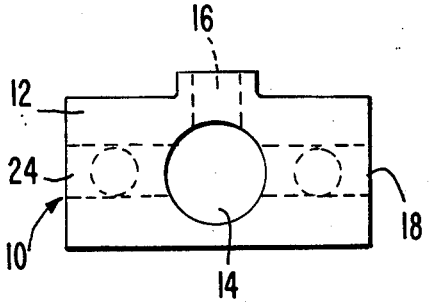
FIG. 5 is an end elevation view of the valve housing of FIG. 4.
Figure 6:
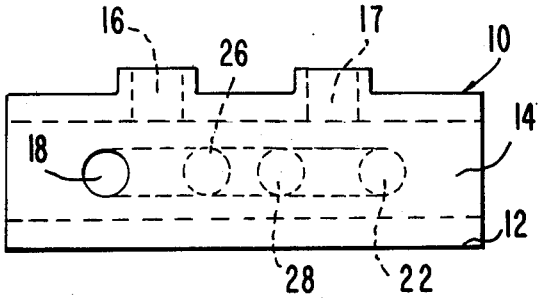
FIG. 6 is a side elevation view of the valve housing of FIG. 4.
Figure 7:
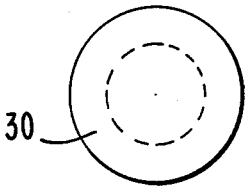
FIG. 7 is an end elevation view of a valve pin for a valve according to the present invention.
Figure 8:
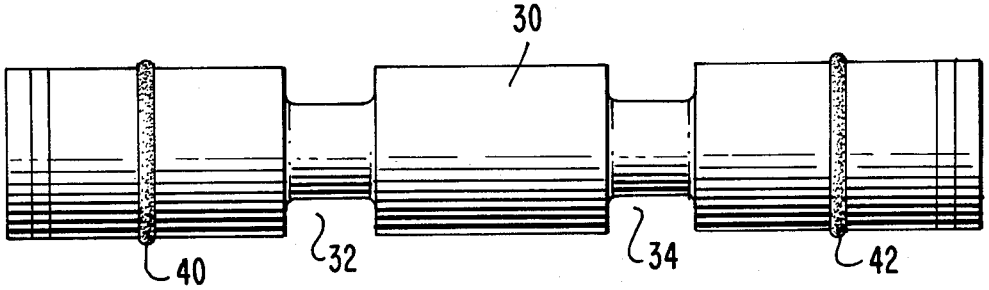
FIG. 8 is a side elevation view of the valve pin of FIG. 7.

Communication of supply port 16 with one of the delivery ports 18 or 24 is establishable simultaneously with discharge port 17 communication with the other of the delivery ports. FIG. 3 shows that at no time is either supply port 16 or discharge port 17 in simultaneous communication with either of the delivery ports 18 or 24.

Suitable means, such as C-shaped locking rings 36 and 38 fitting into corresponding grooves on valve pin 30, prevent the slidable valve pin from passing outside of valve housing 12. Rubber O-rings 40 and 42 provide seals between slidable valve pin 30 and housing 12.

FIG. 1 illustrates a valve according to the present invention operably connected to a hydraulic cylinder 44, as well as to a hydraulic pump P and hydraulic sump tank T. Delivery port 18 of valve 10 is connected to blind end drive cylinder port 58 of hydraulic drive cylinder housing 60 within which operates the hydraulically operated reciprocating piston 52. The piston 52 controls extension and retraction of cylinder rod 46. A line 54 is connected to rod end drive cylinder port 62 for draining hydraulic fluid from cylinder 44 during extension of rod 46, and for introducing hydraulic fluid into cylinder 44 for effecting retraction of rod 46.

In the embodiment shown in FIG. 1, slidable pin 30 is positioned within valve 10 for extension of cylinder rod 46 by application of fluid pressure from pump P through line 48, valve supply port 16, pin groove 32, valve bore opening 20, valve delivery port 18, line 50 and blind end cylinder port 58 to hydraulic cylinder 44 for the application of fluid pressure to piston 52 connected to piston rod 46. The resultant extension of cylinder rod 46 forces hydraulic fluid from the rod side of hydraulic cylinder 44 through rod end cylinder port 62, line 54, valve delivery port 24, valve bore opening 28, pin groove 34, valve discharge port 17, and line 56 to stump tank T from where it is recycled by pump P.

Figure 2:
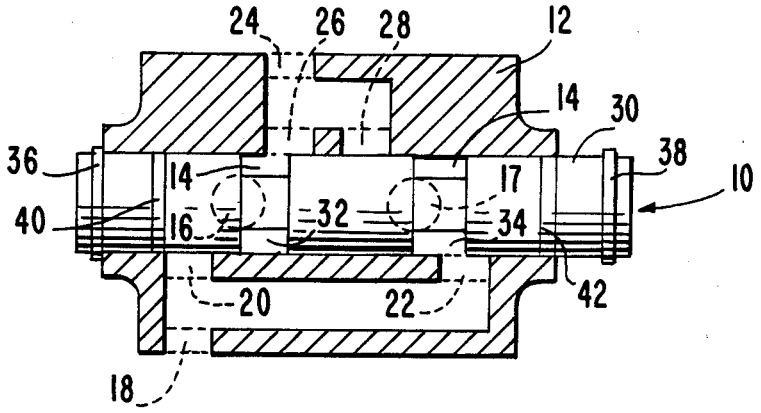
FIG. 2 is a sectional view of the hydraulic control valve of FIG. 1, positioned for retraction of a hydraulic cylinder rod.

FIG. 2 shows the position of slidable pin 30 within valve 10 for application of fluid pressure to retract a cylinder rod. In this position, hydraulic fluid is pumped into valve supply port 16 and thereafter through valve pin groove 32, valve bore opening 26 and valve delivery port 24 to effect cylinder rod retraction, Fluid draining from the blind end of the cylinder during retraction enters valve delivery port 18 and flows through valve bore opening 22, pin groove 34, and exits valve 10 through valve discharge port 17 to the sump tank for recycling.

For automatic retraction of a cylinder rod after extension thereof, and vice versa, means are provided for connecting the cylinder rod 46 and the slidable valve pin 30 at predetermined cylinder rod extension and retraction positions. The rod and pin connecting means are capable of sliding the valve pin within the valve bore at predetermined extension and retraction positions to shift supply port communication between discharge ports 18 and 24, and thereby reverse direction of travel of a cylinder rod.

Cylinder 44 includes a hydraulically operated reciprocating piston 52 therein, the piston controlling extension and retraction of rod 46 connected to the piston. A rod and pin connecting member provides means for reciprocating the pin, and is successively actuatable by respective extension and retraction of rod 46.

Figure 9:
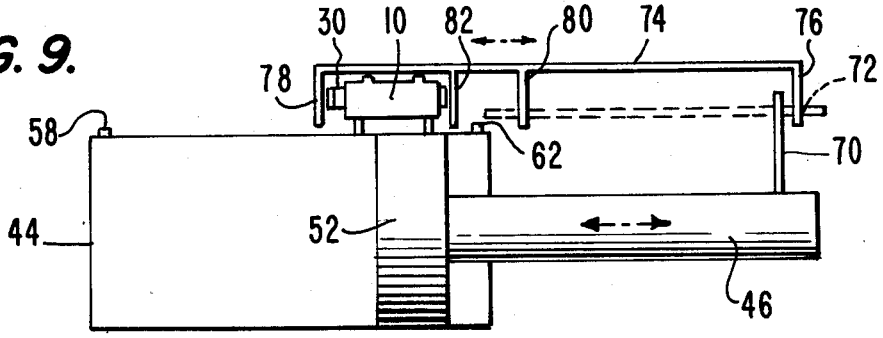
FIG. 9 is a schematic view showing a valve according to the invention with automatic valve control means for extension and retraction of a hydraulic cylinder rod.

In the embodiment shown in FIG. 9, a hydraulic valve 10 according to the invention is mounted on a hydraulic cylinder for cooperation with a rod and pin connecting member 74. As can be seen in FIGS. 1 and 9, the ends of pin 30 extend from opposite ends of housing 12 providing means for reciprocating the pin 30 within the valve bore to shift supply port communication between discharge ports 18 and 24. The ends of pin 30 are adapted for connecting to drive cylinder 44 by means including rod and pin connecting member 74.

As shown in FIG. 9, the cylinder rod reversing means includes a tab 70 extending laterally from cylinder rod 46. Tab 70 is guided on track means 72 and is positioned for cooperation with a rod and pin connecting member 74. Rod and pin connecting member 74 is slidable in the same direction as cylinder rod 46, and can be guided on track 72 or other suitable means. During extension of cylinder rod 46, tab 70 contacts a first contact member 76 of rod and pin connecting member 74 at a predetermined position. Upon further extension of rod 46 and tab 70, the first contact member 76 is moved by tab 70 in the same direction as rod 46. A pin contacting fence 78 is provided at an opposite end of rod and pin connecting member 74 from the first contact member 76. Movement of contact member 76 brought about by extension of cylinder rod 46 results in corresponding movement of pin fence 78 causing the valve pin 30 to slide within the valve bore and shift supply port communication between discharge ports of the valve and thereby reverse direction of travel of the rod to effect rod retraction.

The rod and pin connecting member 74 is provided with a second contact member 80 for effecting reversal of cylinder rod direction upon retraction of the cylinder rod to a predetermined position. The second contact member 80 extends from rod and pin connecting member 74 in position to contact tab 70 upon retraction of the rod to a predetermined position. When contact between tab 70 and contact member 80 is made, and upon further retraction of rod 46 and tab 70, second contact member 80 is moved in the direction of travel of the rod, as is a second pin fence 82 extending from rod and pin connecting member 74. Movement of second pin fence member 82 causes the valve pin 30 to slide within the valve bore and shift supply port communication between the discharge ports and thereby reverse direction of travel of the rod to effect rod extension.

Advantageously, the first and second contact members 76 and 80 are selectively positionable for contact with tab 70 to permit manual or automatic control of valve 10. According to this embodiment, the contact members can be moved out of the path of tab 70, permitting manual operation of the valve for extension permitting manual operation of the valve for extension and retraction of a cylinder rod if automatic reversal of the cylinder rod is not desired. Any suitable means can be utilized for selective positioning of contact members 76 and 80, including locking screws, pressure actuated clamps, hinges, and the like.

The above-described embodiment provides a hydraulic valve with a single moving part which is relatively simple and inexpensive to manufacture yet provides for a reliable automatic reversing of a drive cylinder rod without electricity.

The positioning of the various ports of valve 10 about the axis of pin 30 need not necessarily be as depicted in the drawings, for example, delivery port 24 can be positioned in different relationship with delivery port 18, e.g., offset about the pin axis by 90° from the position shown in the drawings.

Figure 10:
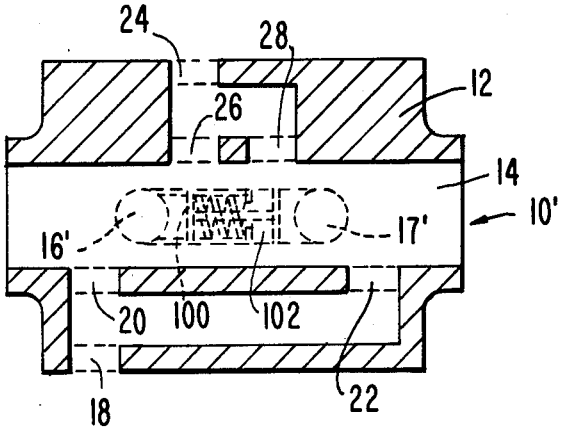
FIG. 10 is a sectional view, partly schematic, of a valve housing according to one embodiment including a pressure relief valve.
Figure 11:
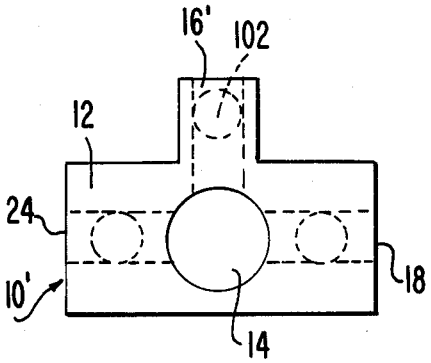
FIG. 11 is an end elevation view of the valve housing of FIG. 10.
Figure 12:
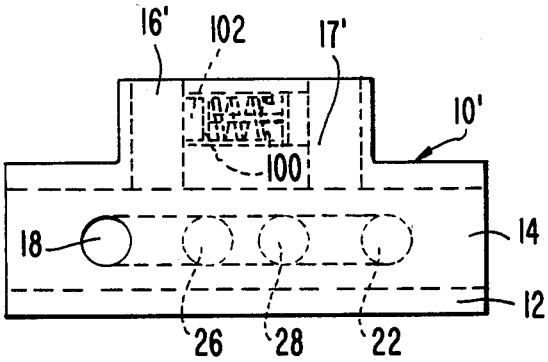
FIG. 12 is a side elevation view of the valve housing of FIG. 10.

In another embodiment, a pressure relief valve 100 is provided between supply port 16' and discharge port 17'. See FIGS. 10, 11 and 12. Pressure relief valve 100 is disposed in a passageway 102 connecting supply port 16' and discharge port 17', and operates at a predetermined hydraulic pressure level to shunt hydraulic fluid from supply port 16' to discharge port 17' and to the sump tank.

Figure 13:
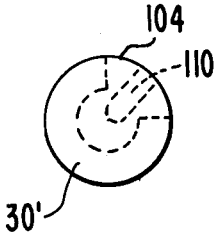
FIG. 13 is an end elevation view of an adjustable valve pin according to one embodiment.
Figure 14:
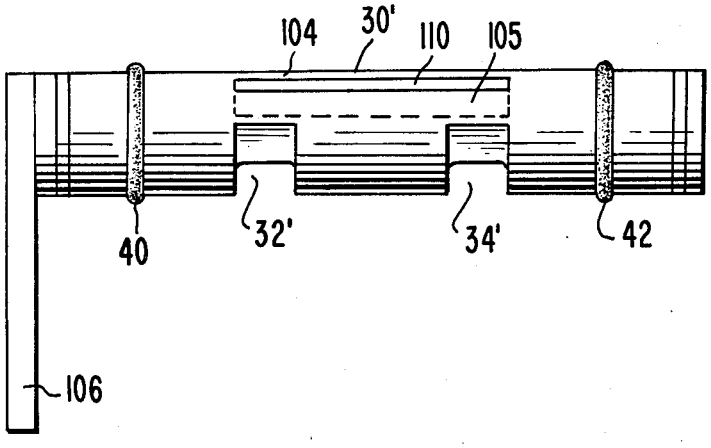
FIG. 14 is a side elevation view of the valve pin of FIG. 13.

FIGS. 13 and 14 show a modified reciprocating valve pin 30' according to the present invention. According to this embodiment, pin grooves 32' and 34' do not extend completely around the pin, leaving pin surface control portions 104 and 105. A passageway such as slot 110 connects pin surface control portions 104 and 105, such that when the pin is rotated with handle 106 to place the pin surface control portions 104 and 105 into alignment with supply port 16' and discharge port 17' respectively, fluid being pumped into supply port 16' is shunted to discharge port 17' through slot 110 and then to the sump tank, thereby bypassing both delivery ports and the associated hydraulic cylinder. Rotatable pin 30' allows manual control of a hydraulic cylinder through selective application of fluid pressure to a desired end of the hydraulic cylinder by rotation and/or reciprocation of pin 30' using handle 106.

Since many modifications, variations and changes in detail may be made to the described embodiment, it is intended that all matter in the foregoing description and shown in the accompanying drawings be interpreted as illustrative and not in a limiting sense.

What is claimed is:

1. A hydraulic control valve comprising:

(a) a valve housing including a cylindrical valve bore, the valve housing further including a supply port in communication with the valve bore, a discharge port in communication with the valve bore, a first delivery port having first and second openings into the valve bore, and a second delivery port having first and second openings into the valve bore; the hydraulic control valve further comprising:

(b) a valve pin slidable within the valve bore, the valve pin including a first pin groove operable to establish communication between the supply port and either of the delivery ports to the exclusion of the other delivery port, which supply port communication is establishable through corresponding first valve bore openings of the respective delivery ports, and a second pin groove operable to establish communication between the discharge port and either of the delivery ports to the exclusion of the other delivery port, which discharge port communication is establishable through corresponding second valve bore openings of the respective delivery ports; and (c) means for rotating said pin within said bore, wherein said pin grooves extend only partly around the periphery of the pin leaving pin surface control portions which when aligned with the supply port and the discharge port upon rotation of the pin prevent delivery of fluid pressure to either of said delivery ports, wherein supply port communication with one of the delivery ports is establishable simultaneously with discharge port communication with the other delivery port.

2. The hydraulic control valve of claim 1 further including means for reciprocating said pin within said valve bore to thereby shift supply port communication between said discharge ports, said reciprocating means being adapted for connecting to a drive cylinder having a hydraulically operated reciprocating piston therein, the piston controlling extension and retraction of a rod connected to the piston, said pin reciprocating means being successively actuatable by respective extension and retraction of said rod.

3. The hydraulic control valve of claim 2 further including a pressure relief valve positioned in a passageway connecting the supply port and the discharge port, the pressure relief valve being adapted to permit fluid flow from the supply port to the discharge port at a predetermined fluid pressure level.

4. The hydraulic control valve of claim 1 further including a pressure relief valve positioned in a passageway connecting the supply port and the discharge port, the pressure relief valve being adapted to permit fluid flow from the supply port to the discharge port at a predetermined fluid pressure level.

5. The hydraulic control valve of claim 1 further including means for manually and selectively shunting fluid directly from said supply port to said discharge port and thereby bypassing said delivery ports.

6. The hydraulic control valve of claim 5 wherein the manual shunting means comprises a passage between the pin surface control portions which connect the supply port to the discharge port upon alignment of the pin surface control portions therewith.

7. In combination (a) a hydraulic valve according to claim 1;

(b) a drive cylinder having ports at opposite ends thereof and housing a hydraulically operated reciprocating piston, the piston controlling extension and retraction of a rod connected to the piston, one drive cylinder port being connected to said first delivery port of the valve for effecting extension of said rod, the other drive cylinder port being connected to said delivery port the valve for effecting retraction of said rod; and (c) means for connecting the cylinder rod and said valve pin at predetermined rod extension and retraction positions, the rod and pin connecting means being capable of sliding the valve pin within the valve bore at said predetermined positions to shift supply port communication between said discharge ports and thereby reverse direction of travel of said rod.

8. The combination of claim 7 wherein the rod and pin connecting means comprises:

(a) tab means extending laterally from said cylinder rod;

(b) a first contact member connectable with said valve pin, the first contact member being contacted by said tab means upon extension of said rod to a predetermined position, further extension of said rod and tab means moving the first contact member and thereby causing the valve pin to slide within the valve bore and shift supply port communication between said discharge ports and thereby reverse direction of travel of said rod; and (c) a second contact member connectable with said valve pin, the second contact member being contacted by said tab means upon retraction of said rod to a predetermined position, further retraction of said rod and tab means moving the second contact member and thereby causing the valve pin to slide within the valve bore and shift supply port communication between said discharge ports and thereby reverse direction of travel of said rod.

9. The combination of claim 8 wherein the first and second contact members can be selectively positioned for contact with said tab means.

10. A hydraulic control valve comprising:

(a) a valve housing including a cylindrical valve bore, the valve housing further including a supply port in communication with the valve bore, a discharge port in communication with the valve bore, a first delivery port having first and second openings into the valve bore, and a second delivery port having first and second openings into the valve bore; the hydraulic control valve further comprising:

(b) a valve pin slidable within the valve bore, the valve pin including a first pin groove operable to establich communication between the supply port and either of the delivery ports to the exclusion of the other delivery port, which supply port communication is establishable through corresponding first valve bore openings of the respective delivery ports, and a second pin groove operable to establish communication between the discharge port and either of the delivery ports to the exclusion of the other delivery port, which discharge port communication is establishable through corresponding second valve bore openings of the respective delivery ports;

(c) a pressure relief valve positioned in a passageway connecting the supply port and the discharge port, the pressure relief valve being adapted to permit fluid flow from the supply port to the discharge port at a predetermined fluid pressure level, wherein supply port communication with one of the delivery ports is establishable simultaneously with discharge port communication with the other delivery port.

11. The hydraulic control valve of claim 10 further including means for manually and selectively shunting fluid directly from said supply port to said discharge port and thereby bypassing said delivery ports.

12. The hydraulic control valve of claim 11 wherein the manual shunting means comprises a passage between the pin surface control portions which connect the supply port to the discharge port upon alignment of the pin surface control portions therewith.

13. In combination (a) a hydraulic control valve comprising:

(i) a valve housing including a cylindrical valve bore, the valve housing further including a supply port in communication with the valve bore, a discharge port in communication with the valve bore, a first delivery port having first and second openings into the valve bore, and a second delivery port having first and second openings into the valve bore;

the hydraulic control valve further comprising:

(ii) a valve pin slidable within the valve bore, the valve pin including a first pin groove operable to establish communication between the supply port and either of the delivery ports to the exclusion of the other delivery port, which supply port communication is establishable through corresponding first valve bore openings of the respective delivery ports, and a second pin groove operable to establish communication between the discharge port and either of the delivery ports to the exclusion of the other delivery port, which discharge port communication is establishable through corresponding second valve bore openings of the respective delivery ports;

wherein supply port communication with one of the delivery ports is establishable simultaneously with discharge port communication with the other delivery port, (b) a drive cylinder having ports at opposite ends thereof and housing a hydraulically operated reciprocating piston, the piston controlling extension and retraction of a rod connected to the piston, one drive cylinder port being connected to said first delivery port of the valve for effecting extension of said rod, the other drive cylinder port being connected to said second delivery port the valve for effecting retraction of said rod; and (c) means for connecting the cylinder rod and said valve pin at predetermined rod extension and retraction positions, the rod and pin connecting means being capable of sliding the valve pin within the valve bore at said predetermined positions to shift supply port communication between said discharge ports and thereby reverse direction of travel of said rod.

14. In combination:

(i) a hydraulic control valve comprising:

(a) a valve housing including a cylindrical valve bore, the valve housing further including a supply port in the valve housing in communication with the valve bore, a discharge port in the valve housing in communication with the valve bore, a first delivery port in the valve housing in communication with a first blind bore within the valve housing, the first blind bore having first and second openings into the valve bore, and a second delivery port in the valve housing in communication with a second blind bore within the valve housing, the second blind bore having first and second openings into the valve bore; the hydraulic control valve further comprising:

(b) a valve pin slidable within the valve bore, the valve pin including a first pin groove operable to establish communication between the supply port and either of the delivery ports to the exclusion of the other delivery port, which supply port communication is establishable through corresponding first valve bore openings communicating with respective delivery ports through respective blind bores, and a second pin groove operable to establish communication between the discharge port and either of the delivery ports to the exclusion of the other delivery port, which discharge port communication is establishable through corresponding second valve bore openings communicating with respective delivery ports through respective blind bores;

wherein supply port communication with one of the delivery ports is establishable simultaneously with discharge port communication with the other delivery port; and (ii) a drive cylinder having ports at opposite ends thereof and housing a hydraulically operated reciprocating piston, one drive cylinder port being connected to the first delivery port of the valve, the other drive cylinder port being connected to the second delivery port of the valve.

15. The combination of claim 14 further including means for rotating said pin within said bore, wherein said pin grooves extend only partly around the periphery of the pin leaving pin surface control portions which when aligned with the supply port and the discharge port upon rotation of the pin prevent delivery of fluid pressure to either of said delivery ports.

16. The combination of claim 14 further including means for rotating said pin within said bore, wherein said pin grooves extend only partly around the periphery of the pin leaving pin surface control portions which when aligned with the supply port and the discharge port upon rotation of the pin prevent delivery of fluid pressure to either of said delivery ports.

17. The combination of claim 16 further including a pressure relief valve positioned in a passageway connecting the supply port and the discharge port, the pressure relief valve being adapted to permit fluid flow from the supply port to the discharge port at a predetermined fluid pressure level.

18. The combination of claim 17 further including means for manually and selectively shunting fluid directly from said supply port to said discharge port and thereby bypassing said delivery ports.

19. The combination of claim 18 wherein the manual shunting means comprises a passage between the pin surface control portions which connect the supply port to the discharge port upon alignment of the pin surface control portions therewith.

20. The combination of claim 16 further including means for manually and selectively shunting fluid directly from said supply port to said discharge port and thereby bypassing said delivery ports.

21. The combination of claim 20 wherein the manual shunting means comprises a passage between the pin surface control portions which connect the supply port to the discharge port upon alignment of the pin surface control portions therewith.

22. In combination:

(i) a hydraulic control valve comprising:

(a) a valve housing including a cylindrical valve bore having valve bore axis, the valve housing further including a supply port in the valve housing in communication with the valve bore, a discharge port in the valve housing in communication with the valve bore, a first delivery port in the valve housing on a first side thereof with respect to the valve bore axis and in communication with a first blind bore within the valve housing, the first blind bore having first and second openings into the valve bore, and a second delivery port in the valve housing on a second side thereof with respect to the valve bore axis and in communication with a second blind bore within the valve housing, the second blind bore having first and second openings into the valve bore;

the hydraulic control valve further comprising:

(b) a valve pin slidable within the valve bore, the valve pin including a first pin groove operable to establish communication between the supply port and either of the delivery ports to the exclusion of the other delivery port, which supply port communication is establishable through corresponding first valve bore openings communicating with respective delivery ports through respective blind bores, and a second pin groove operable to establish communication between the discharge port and either of the delivery ports to the exclusion of the other delivery port, which discharge port communication is establishable through corresponding second valve bore openings communicating with respective delivery ports through respective blind bores; wherein supply port communication with one of the delivery ports is establishable simultaneously with discharge port communication with the other delivery port; and (ii) a drive cylinder having ports at opposite ends thereof and housing a hydraulically operated reciprocating piston, one drive cylinder port being connected to the first delivery port of the valve, the other drive cylinder port being connected to the second delivery port of the valve.

23. The combination of claim 22 wherein the supply port is on a third side of the valve housing with respect to the valve bore axis.

24. The combination of claim 22 wherein the discharge port is on a third side of the valve housing with respect to the valve bore axis.

25. The combination of claim 22 wherein the supply port and the discharge port are on a third side of the valve housing with respect to the valve bore axis.

26. The combination of claim 22 wherein the first and second delivery ports and their respective blind bores are on opposite sides of the valve housing with respect to the valve bore axis.

* * * * *

UNITED STATES PATENT AND TRADEMARK OFFICE

CERTIFICATE OF CORRECTION

PATENT NO. : 4,691,618

DATED : September 8, 1987

INVENTOR(S) : Denzil C. Poling

It is certified that error appears in the above-identified patent and that said Letters Patent is hereby corrected as shown below:

In claim 7, at column 6, line 37, insert --second-- before "delivery" and insert --of-- before "the";

In claim 13, at column 8, line 14, insert --of-- before "the".

Signed and Sealed this

Seventeenth Day of May, 1988

*Attest:*

DONALD J. QUIGG

*Attesting Officer*

*Commissioner of Patents and Trademarks*